US011331907B2

(12) United States Patent
Matsumoto et al.

(10) Patent No.: US 11,331,907 B2
(45) Date of Patent: May 17, 2022

(54) LIQUID EJECTING APPARATUS AND METHOD FOR CONTROLLING THE SAME

(71) Applicant: SEIKO EPSON CORPORATION, Tokyo (JP)

(72) Inventors: Daisuke Matsumoto, Matsumoto (JP); Kei Yamaguchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/907,712

(22) Filed: Jun. 22, 2020

(65) Prior Publication Data

US 2020/0398557 A1 Dec. 24, 2020

(30) Foreign Application Priority Data

Jun. 24, 2019 (JP) ..... JP2019-116205

(51) Int. Cl.
*B41J 2/045* (2006.01)
*B41J 2/14* (2006.01)

(52) U.S. Cl.
CPC ..... *B41J 2/04541* (2013.01); *B41J 2/04551* (2013.01); *B41J 2/04581* (2013.01); *B41J 2/14201* (2013.01)

(58) Field of Classification Search
CPC ..... B41J 2/04596
See application file for complete search history.

(56) References Cited

U.S. PATENT DOCUMENTS

2011/0234671 A1* 9/2011 Suzuki ..... B41J 2/16526 347/14
2019/0047284 A1* 2/2019 Hettier ..... B41J 2/04573

FOREIGN PATENT DOCUMENTS

| | | | |
|---|---|---|---|
| JP | 2000-280464 | A | 10/2000 |
| JP | 2010-179531 | A | 8/2010 |
| JP | 2012-096423 | A | 5/2012 |
| JP | 2013-082154 | A | 5/2013 |
| JP | 2016-016614 | A | 2/2016 |

* cited by examiner

*Primary Examiner* — Shelby L Fidler
(74) *Attorney, Agent, or Firm* — Workman Nydegger

(57) ABSTRACT

A liquid ejecting apparatus executing a print operation of ejecting liquid to a medium when a print job is input includes nozzles configured to eject liquid, piezoelectric elements corresponding to the nozzles, and driving circuits configured to supply a micro vibration pulse for generating micro vibration in the liquid included in the nozzles without ejection of the liquid from the nozzles to the piezoelectric elements. Strength of the micro vibration generated by the micro vibration pulse varies based on the print job.

8 Claims, 5 Drawing Sheets

LIQUID EJECTING APPARATUS AND METHOD FOR CONTROLLING THE SAME

The present application is based on, and claims priority from JP Application Serial Number 2019-116205, filed Jun. 24, 2019, the disclosure of which is hereby incorporated by reference herein in its entirety.

BACKGROUND

1. Technical Field

The present disclosure relates to a liquid ejecting apparatus and a method for controlling the liquid ejecting apparatus.

2. Related Art

Liquid ejecting apparatuses ejecting liquid, such as ink, to a media, such as printing sheets, have a problem in viscosity of the liquid caused by evaporation of moisture, for example. JP-A-2012-96423 discloses a configuration for reducing local viscosity of liquid by performing micro vibration on the liquid in the vicinity of nozzles. Strength of the micro vibration is controlled in accordance with a state of the viscosity of the liquid. JP-A-2012-96423 also discloses a configuration in which an amount of forcible ejection of ink to a target other than media performed by a flushing operation is controlled in accordance with strength of micro vibration. Specifically, an ejecting amount in flushing obtained when the micro vibration is strong is larger than an ejecting amount of flushing obtained when the micro vibration is weak.

The technique disclosed in JP-A-2012-96423 controls the strength of the micro vibration in accordance with a degree of the viscosity of the liquid. Therefore, in the state in which the viscosity of the liquid is high, the strength of the micro vibration is high irrespective of content of a print job. For example, even when a print operation to be performed for an extremely short period of time is instructed by a print job, micro vibration of high strength is applied to the liquid. Since the ink is stirred by the micro vibration of the unnecessarily high strength, the ink of high viscosity is dispersed in a large range in a pressure chamber. Accordingly, a large amount of liquid is required to be ejected by the flushing operation so that an adverse effect of the viscosity is reduced.

SUMMARY

According to an aspect of the present disclosure, a liquid ejecting apparatus executing a print operation of ejecting liquid to a medium when a print job is input, includes nozzles configured to eject liquid, piezoelectric elements corresponding to the nozzles, and driving circuit configured to supply a micro vibration pulse for generating micro vibration in the liquid included in the nozzles without ejection of the liquid from the nozzles to the piezoelectric elements. Strength of the micro vibration generated by the micro vibration pulse varies depending on the print job.

According to another aspect of the present disclosure, a liquid ejecting apparatus includes nozzles configured to eject liquid, piezoelectric elements corresponding to the nozzles, and driving circuits configured to supply a micro vibration pulse for generating micro vibration in the liquid included in the nozzles without ejection of the liquid from the nozzles to the piezoelectric elements. The liquid ejecting apparatus operates in one of a plurality of modes including a first mode in which a maximum value of strength of micro vibration generated by the micro vibration pulse is a first strength and a second mode in which a maximum value of strength of micro vibration generated by the micro vibration pulse is a second strength lower than the first strength.

According to a further aspect of the present disclosure, in a method for controlling a liquid ejecting apparatus which executes a print operation of ejecting liquid to a medium when a print job is input and which includes nozzles ejecting liquid, piezoelectric elements corresponding to the nozzles, and driving circuits supplying a micro vibration pulse for generating micro vibration in the liquid in the nozzles without ejection of the liquid from the nozzles to the piezoelectric elements, strength of the micro vibration generated by the micro vibration pulse is controlled in accordance with the print job.

According to a still further aspect of the present disclosure, in a method for controlling a liquid ejecting apparatus including nozzles ejecting liquid, piezoelectric elements corresponding to the nozzles, and driving circuits supplying a micro vibration pulse for generating micro vibration in the liquid in the nozzles to the piezoelectric elements without ejection of the liquid from the nozzles, the liquid ejecting apparatus operates in one of a plurality of modes including a first mode in which a maximum value of strength of the micro vibration generated by the micro vibration pulse is a first strength and a second mode in which a maximum value of strength of the micro vibration generated by the micro vibration pulse is a second strength lower than the first strength.

DESCRIPTION OF EXEMPLARY EMBODIMENTS

A: First Embodiment

Figure 1:
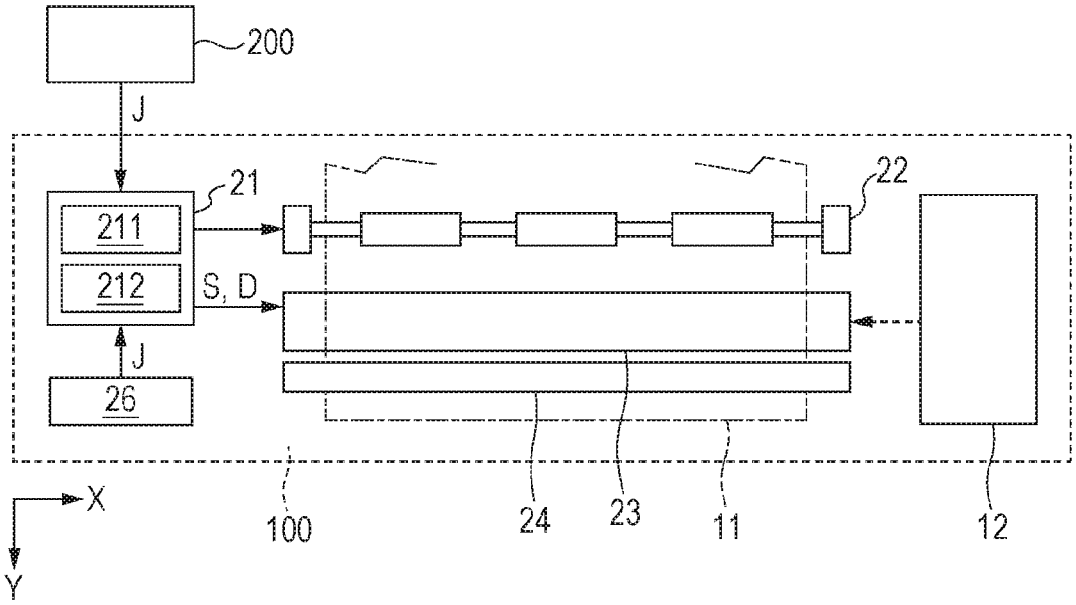
FIG. 1 is a block diagram illustrating a configuration of a liquid ejecting apparatus according to a first embodiment.

FIG. 1 is a block diagram illustrating a configuration of a liquid ejecting apparatus 100 according to a first embodiment. The liquid ejecting apparatus 100 of the first embodiment is an ink jet print apparatus ejecting droplets of ink which is an example of liquid to a medium 11. The medium 11 is a printing sheet, for example. Note that a printing target of an arbitrary material, such as a resin film or fabric, may be used as the medium 11. The liquid ejecting apparatus 100 includes a liquid container 12. The liquid container 12 stores ink. It is assumed here that a cartridge detachable from the liquid ejecting apparatus 100, a bag-like ink pack formed of a flexible film, or an ink tank which may be refilled with ink is used as the liquid container 12. Note that an arbitrary number of types of ink are stored in the liquid container 12.

An external apparatus 200 is coupled to the liquid ejecting apparatus 100 in a wired or wireless manner. The external apparatus 200 is an electronic apparatus which processes images, such as a computer, a digital still camera, or a cellular phone. The external apparatus 200 successively supplies print jobs J to the liquid ejecting apparatus 100. Such a print job J is an instruction for performing a series of operations of printing of an image on the medium 11. For example, the print job J instructs various conditions including the number of copies, duty, color/monochrome, a medium size, an image quality mode (high quality/normal/low quality), and a direction of the medium 11 to be transported by a transport mechanism 22 (a longitudinal direction/a lateral direction).

As illustrated in FIG. 1, the liquid ejecting apparatus 100 includes a control unit 21, the transport mechanism 22, a liquid ejecting head 23, a maintenance mechanism 24, and an operation device 26. The control unit 21 controls the various components included in the liquid ejecting apparatus 100. The print job J is supplied from the external apparatus 200 to the control unit 21. The transport mechanism 22 transports the medium 11 along a Y axis under control of the control unit 21.

The control unit 21 includes a control device 211 and a storage device 212. The control device 211 is at least one processor executing various calculations and various control operations. Specifically, the control device 211 is constituted by at least one type of processor including a central processing unit (CPU), a graphics processing unit (GPU), a digital signal processor (DSP), or a field programmable gate array (FPGA). The storage device 212 is at least one memory storing programs to be executed by the control device 211 and various data to be used by the control device 211. For example, a general recording medium, such as a semiconductor recording medium or a magnetic recording medium, is used as the storage device 212. A combination of a plurality of types of recording medium may be used as the storage device 212.

The operation device 26 is constituted by an operator or a touch panel, for example, and receives instructions issued by a user. For example, the operation device 26 receives the print job J from the user. As is apparent from the foregoing description, the print job J is not only input from the external apparatus 200 to the control unit 21 but also input from the operation device 26 to the control unit 21 by means of an operation performed by the user. For example, in a copy operation of printing an image obtained by scanning performed by a scanner, not illustrated, on the medium 11 or a print operation of printing an image stored in a recording medium, such as a memory card or a USB memory, the print job J is input by the user operating the operation device 26.

The liquid ejecting head 23 ejects ink supplied from the liquid container 12 from a plurality of nozzles to the medium 11 under control of the control unit 21. As illustrated in FIG. 1, the liquid ejecting head 23 of the first embodiment is a line head extending along an X axis intersecting with the Y axis. Specifically, a plurality of nozzles are arranged in an entire range of the medium 11 in an X direction. When the liquid ejecting head 23 ejects ink to the medium 11 while the medium 11 is transported by the transport mechanism 22, an arbitrary image is formed on a surface of the medium 11.

Figure 2:
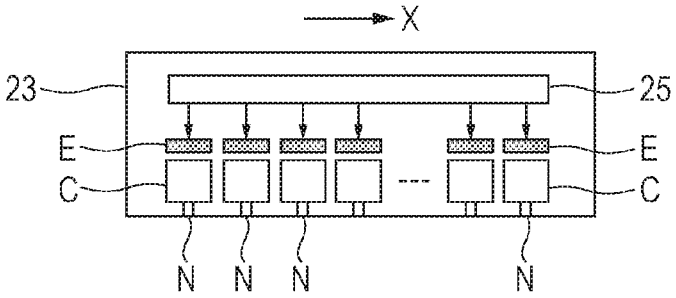
FIG. 2 is a diagram illustrating a configuration of a liquid ejecting head.

FIG. 2 is a diagram schematically illustrating a configuration of the liquid ejecting head 23. As illustrated in FIG. 2, the liquid ejecting head 23 includes a plurality of nozzles N, a plurality of pressure chambers C, and a plurality of driving elements E. The pressure chambers C and the driving elements E are formed for the corresponding nozzles N. The pressure chambers C are spaces communicated with the nozzles N. The liquid container 12 supplies ink to the liquid ejecting head 23 so that the plurality of pressure chambers C are filled with the ink. The driving elements E change pressure of the ink in the pressure chambers C. Piezoelectric elements changing volumes of the pressure chambers C by deforming wall surfaces of the pressure chambers C or heating elements generating bubbles in the pressure chambers C by heating the ink included in the pressure chambers C are used as the driving elements E, for example. Since the driving elements E change the pressure of the ink in the pressure chambers C, the ink included in the pressure chambers C is ejected from the nozzles N. When a state in which the ink is not ejected from the nozzles N of the liquid ejecting head 23 is continued, viscosity of the ink included in the nozzles N is increased due to evaporation of moisture.

As illustrated in FIG. 1, the control unit 21 supplies a plurality of signals including a control signal S and a driving signal D to the liquid ejecting head 23. The control signal S instructs each of the nozzles N to eject or not to eject the ink every predetermined period of time U (hereinafter referred to as a unit period U). The driving signal D is a voltage signal changed in a cycle of the unit period U.

Figure 3:
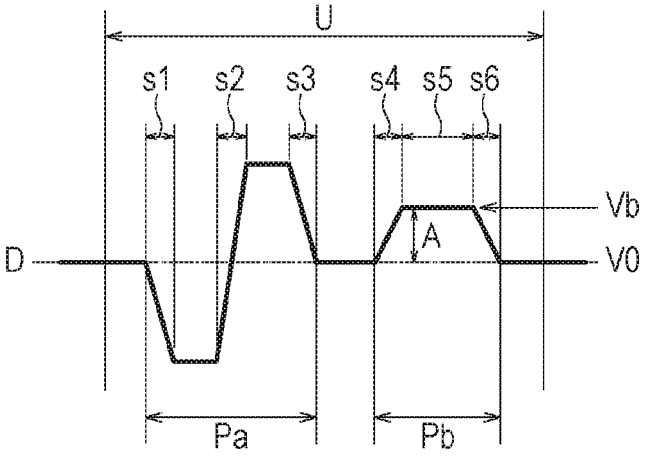
FIG. 3 is a waveform chart of a driving signal.

FIG. 3 is a waveform chart of the driving signal D. As illustrated in FIG. 3, the driving signal D of the first embodiment includes an ejection pulse Pa and a micro vibration pulse Pb for each unit period U. The ejection pulse Pa drives the driving elements E so that the nozzles N eject the ink. Specifically, the ejection pulse Pa includes intervals s1 to s3. In the interval s1, a predetermined reference potential V0 is lowered. The potential is lowered so that the volume of the pressure chambers C is increased. In the interval S2, the potential lowered in the interval s1 is increased to a potential larger than the reference potential V0. The potential rises so that the volumes of the pressure chambers C are reduced. In the interval s3, the potential increased in the interval s2 is lowered to the reference potential V0.

The micro vibration pulse Pb generates micro vibration in the ink included in the pressure chambers C without ejecting the ink from the nozzles N. Specifically, the micro vibration pulse Pb includes intervals s4 to s6. In the interval s4, the reference potential V0 is increased to a potential Vb on a high potential side. In the interval s5, the potential Vb of an end of the interval s4 is maintained. In the interval s6, the potential Vb in the interval s5 is lowered to the reference potential V0. Note that a waveform of the micro vibration pulse Pb is appropriately changed. For example, a shape of the pulse is not limited to trapezoid illustrated in FIG. 3, for example, and a rectangle pulse may be employed as the micro vibration pulse Pb. Specifically, a waveform of the micro vibration pulse Pb in the driving signal D is not limited to the waveform illustrated in FIG. 3 and may be arbitrarily changed as long as the waveform indicates vibration of the liquid (meniscus) to the extent that the ink in the pressure chambers C is not ejected from the nozzles N.

As illustrated in FIG. 2, the liquid ejecting head 23 includes a driving circuit 25. The driving circuit 25 drives the plurality of driving elements E under control of the control unit 21. The driving circuit 25 of the first embodiment supplies the ejection pulse Pa or the micro vibration pulse Pb of the driving signal D to the plurality of driving elements E every unit period U. Note that the driving circuit 25 may be disposed outside the liquid ejecting head 23.

Specifically, the driving circuit 25 supplies the ejection pulse Pa to the driving elements E corresponding to the nozzles N receiving an instruction for ejecting ink by the control signal S. Since the driving elements E are operated by supplying the ejection pulse Pa, the ink is ejected from the nozzles N corresponding to the driving elements E. Furthermore, the driving circuit 25 supplies the micro vibration pulse Pb to the driving elements E corresponding to the nozzles N receiving an instruction not for ejecting the ink by the control signal S. Since the driving elements E are operated by supplying the micro vibration pulse Pb, micro vibration is generated in the ink included in the nozzles N corresponding to the driving elements E. The micro vibration pulse Pb may be rephrased as a waveform for vibrating meniscus of the ink included in the nozzles N. Since the ink included in the nozzles N is appropriately stirred by the micro vibration, local increase in viscosity is reduced in the vicinity of the nozzles N.

Strength of the micro vibration depends on a voltage A of the micro vibration pulse Pb. The voltage A corresponds to a potential difference between a highest potential and a lowest potential of the micro vibration pulse Pb, that is, a potential difference between the potential Vb and the reference potential V0 in FIG. 3. Specifically, the strength of the micro vibration is increased as an absolute value of the voltage A is increased. The control unit 21 may control the voltage A of the micro vibration pulse Pb. The control unit 21 of the first embodiment may change the strength of the micro vibration in three stages (strong/middle/weak) by controlling the voltage A.

The maintenance mechanism 24 of FIG. 1 is used for an operation of maintaining the liquid ejecting head 23 (hereinafter referred to as a "maintenance operation"). The maintenance operation includes a flushing operation and a cleaning operation, for example. In the flushing operation, ink is forcibly ejected from the plurality of nozzles N by driving the driving elements E although the ejection of the ink does not directly contribute to formation of an image. In the flushing operation according to the first embodiment, the ink is ejected to a flushing box included in the maintenance mechanism 24, for example. In the cleaning operation, the ink included in the liquid ejecting head 23 is forcibly discharged from the plurality of nozzles N by pressure from an upstream of the liquid ejecting head 23 or suction from a downstream of the liquid ejecting head 23. The maintenance mechanism 24 includes the flushing box which receives and accommodates the ink ejected from the nozzles N by the flushing operation and a cap sealing the plurality of nozzles N when the cleaning operation is executed. Specifically, the cap seals (caps) an ejection surface including the plurality of nozzles N disposed thereon so that an enclosed region having the nozzles N as openings is formed. The ink having the increased viscosity in the liquid ejecting head 23 is discharged to an outside by the maintenance operation. Accordingly, the ink in the liquid ejecting head 23 is maintained in an excellent state by the maintenance operation periodically performed.

Figure 4:
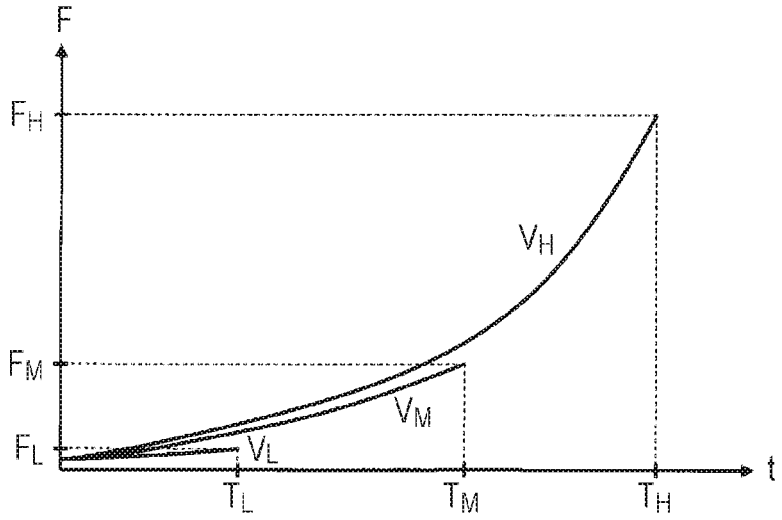
FIG. 4 is a graph illustrating the relationship between a period of time in which a non-ejection state is maintained and an ejection amount required for a flushing operation.

FIG. 4 is a graph of the relationship between a period of time t in a state in which the nozzles N do not eject the ink (hereinafter referred to as a "non-ejection state") is maintained and an ejection amount F of the ink by the flushing operation. The ejection amount F means an amount of ink to be ejected by the flushing operation so that the increase in viscosity of the ink caused in the period of time t is reduced. As described above, the micro vibration is applied to the ink included in the nozzles N in the non-ejection state. In FIG. 4, the relationships between the period of time t and an ejection amount F obtained when the strength of the micro vibration is changed (strong/middle/weak) are illustrated. A strength $V_H$ is larger than a strength $V_M$, and a strength $V_L$ is smaller than the strength $V_M$ ($V_H>V_M>V_L$). The increase in viscosity of the ink proceeds as the period of time t in which the ink is not ejected from the nozzles N is increased. Accordingly, as is apparent from FIG. 4, it is likely that the required ejection amount F in the flushing operation is increased as the period of time t is increased.

In FIG. 4, limit times T ($T_H$, $T_M$, and $T_L$) are illustrated for individual strengths of the micro vibration. The limit times T indicate a period of time until the ink is not appropriately ejected from one of the nozzles N as the viscosity is increased while the non-ejection state is continued in the nozzle N (hereinafter referred to as an "ejection limit"). Specifically, when the period of time in which the non-ejection state is continued is shorter than the limit time T, the ink may be ejected from the nozzle N. On the other hand, when the non-ejection state is continued for the limit time T or more, the ejection limit is reached. When the ejection limit is reached, the maintenance operation is to be executed to reduce the increase in viscosity.

As is apparent from FIG. 4, local increase in viscosity in the nozzle N is reduced when the ink is stirred by the micro vibration. Accordingly, it is likely that, as the strength of the micro vibration is higher, the limit time T until the ejection limit is reached is longer. Specifically, the limit time $T_H$ corresponding to the micro vibration of the strength $V_H$ (strong) is longer than the limit time $T_M$ corresponding to the micro vibration of the strength $V_M$ (middle). Furthermore, the limit time $T_L$ corresponding to the micro vibration of the strength $V_L$ (weak) is shorter than the limit time $T_M$ corresponding to the micro vibration of the strength $V_M$ (middle). As is apparent from the description above, as the strength of the micro vibration is higher, an interval of the flushing operation may be longer. Specifically, as the strength of the micro vibration is higher, frequency of the flushing operation is lowered.

On the other hand, as the strength of the micro vibration is higher, the ink having the increased viscosity in the nozzle N is dispersed in a wide range in the nozzle N and the corresponding pressure chamber C. Accordingly, as the strength of the micro vibration is higher, a required ejection amount F is increased in the flushing operation for reducing the increase in viscosity. For example, the ejection amount $F_H$ obtained when the micro vibration of the strength $V_H$ is applied for the limit time $T_H$ is larger than the ejection amount $F_M$ obtained when the micro vibration of the strength $V_M$ is applied for the limit time $T_M$. Furthermore, the ejection amount $F_L$ obtained when the micro vibration of the strength $V_L$ is applied for the limit time $T_L$ is smaller than the ejection amount $F_M$ obtained when the micro vibration of the strength $V_M$ is applied for the limit time $T_M$.

As is apparent from the description above, as the strength of the micro vibration is higher, the ejection amount F is increased while frequency of the flushing operation is lowered. On the other hand, as the strength of the micro vibration is lower, the frequency of the flushing operation is increased and the ejection amount F is reduced. As the frequency of the flushing operation is lowered, a print speed is increased, and as the ejection amount F is reduced, a consumption amount of the ink is reduced. Accordingly, when the print speed has priority, the frequency of the flushing operation is preferably lowered by setting the micro vibration of the high strength $V_H$. On the other hand, when the reduction of the consumption amount of ink has priority, the ejection amount F is preferably reduced by setting the micro vibration of the low strength $V_L$. Note that the print speed is indicated by the number of sheets to be printed in a unit time (that is, throughput).

A period of time in which the non-ejection state of the nozzles N continues changes depending on a print job J. Taking the circumstances described above into consideration, the control unit 21 of the first embodiment controls the strength of the micro vibration by the micro vibration pulse Pb in accordance with the print job J supplied from the external apparatus 200 or the operation device 26. Specifically, the control unit 21 controls the strength of the micro vibration in accordance with a period T of the print operation (hereinafter referred to as a "print time") calculated in accordance with the print job J. In the print operation, an image instructed by the print job J is printed on the medium 11. Specifically, the print operation includes ejection of the ink by the liquid ejecting head 23 and transport of the medium 11 by the transport mechanism 22.

Figure 5:
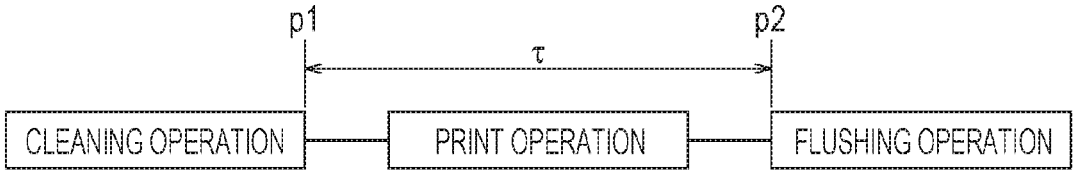
FIG. 5 is a diagram illustrating a print time.

FIG. 5 is a diagram illustrating the print time. As illustrated in FIG. 5, the cleaning operation is executed before the print operation for the print job J is executed and the flushing operation is executed after the print operation is terminated. A starting point of the print time $\tau$ corresponds to a time point p1 when the cleaning operation is terminated. At the time point p1, a capping state for the cleaning operation is cancelled, for example. On the other hand, an end point of the print time $\tau$ corresponds to a time point p2 when the flushing operation is started.

Figure 6:
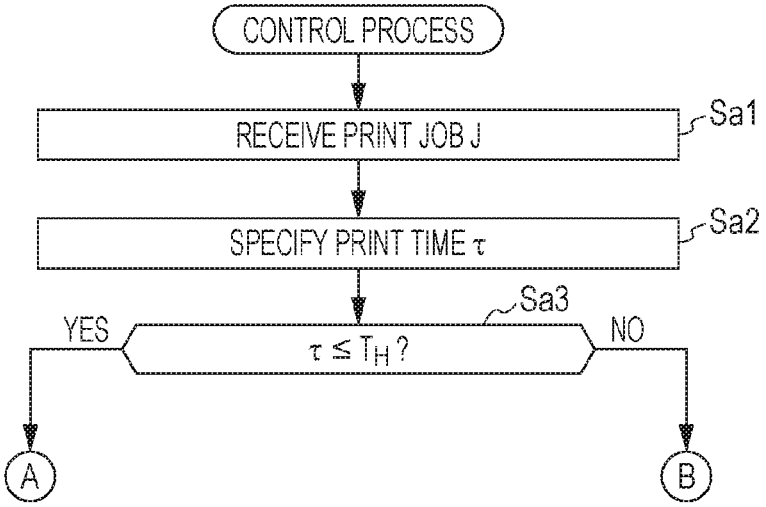
FIG. 6 is a flowchart of a detailed procedure of a control process.
Figure 7:
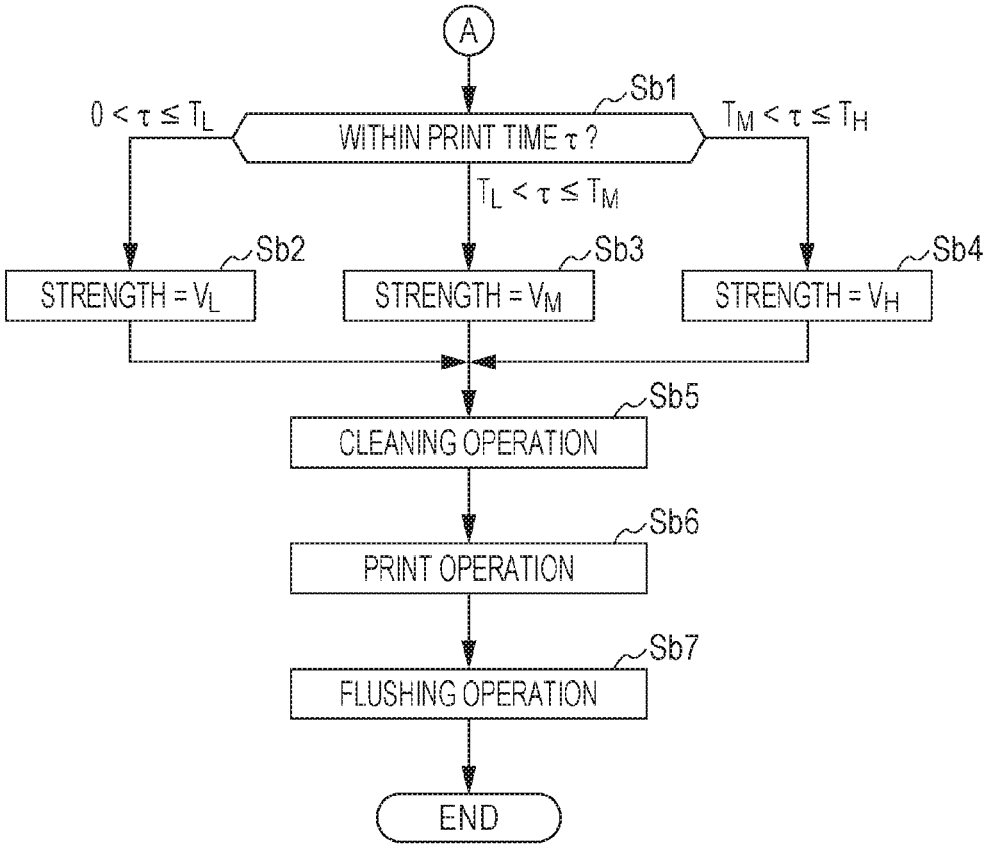
FIG. 7 is a flowchart of the detailed procedure of the control process.
Figure 8:
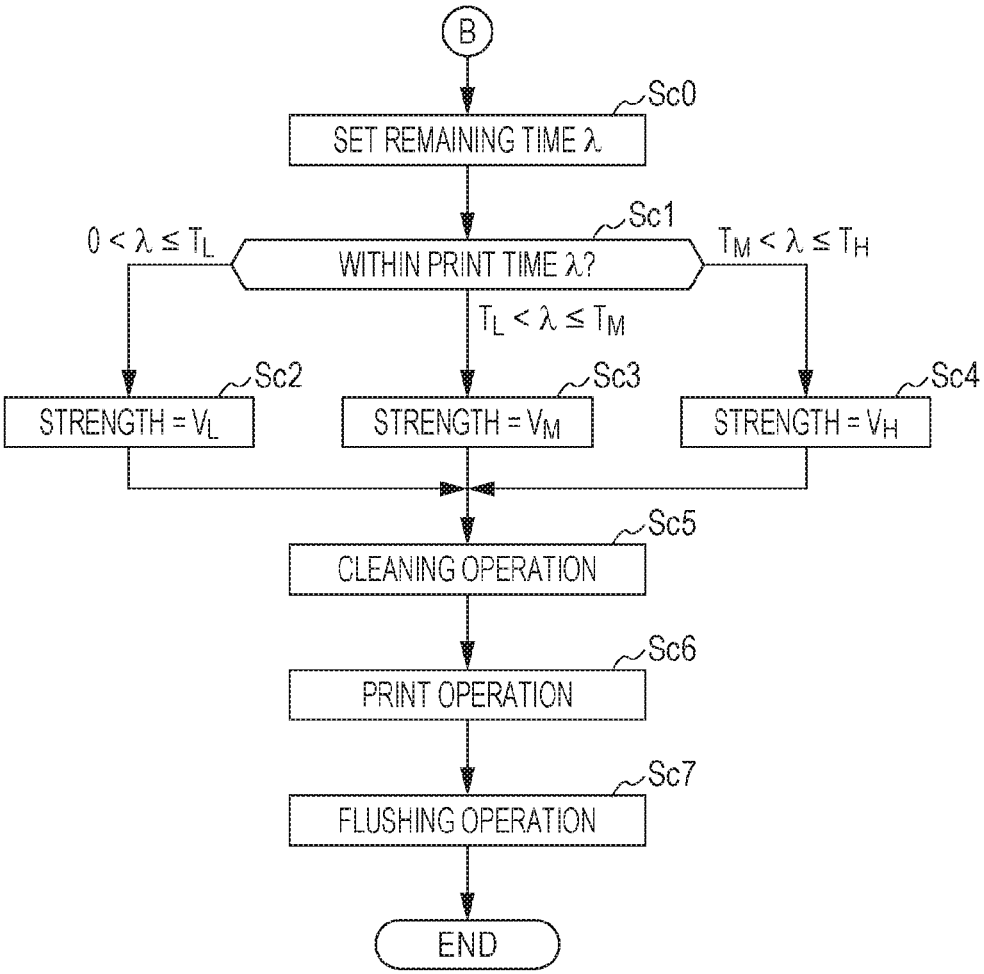
FIG. 8 is a flowchart of the detailed procedure of the control process.

FIGS. 6 to 8 are flowchart of a detailed procedure of a process executed by the control unit 21 (hereinafter referred to as a "control process"). As illustrated in FIG. 6, when the control process is started, the control unit 21 receives the print job J from the external apparatus 200 or the operation device 26 (Sa1). The control unit 21 specifies the print time $\tau$ in accordance with the print job J (Sa2). For example, a table in which a condition specified by the print job J is associated with the print time $\tau$ is stored in the storage device 212, and the control unit 21 searches the table for the print time $\tau$ corresponding to the condition specified by the print job J.

Figure 9:
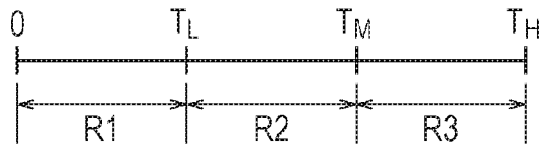
FIG. 9 is a diagram illustrating a range of the print time.

The control unit 21 determines whether the print time $\tau$ specified by the print job J is equal to or smaller than the limit time $T_H$ corresponding to the micro vibration of the strength $V_H$ (Sa3). When the print time $\tau$ is equal to or smaller than the limit time $T_H$ (Sa3: YES), the control unit 21 determines a range of the print time $\tau$ as illustrated in FIG. 7 (Sb1). Specifically, the control unit 21 determines one of a plurality of ranges R (R1 to R3) including the print time $\tau$. As illustrated in FIG. 9, the ranges R are sectioned by the limit times T ($T_L$, $T_M$, and $T_H$) as boundaries. Specifically, the first range R1 is equal to or smaller than the limit time $T_L$ corresponding to the micro vibration of the strength $V_L$ ($0<\tau\leq T_L$). The third range R3 is larger than the limit time $T_M$ corresponding to the micro vibration of the strength $V_M$ ($T_M<\tau\leq T_H$). The second range R2 is between the first range R1 and the third range R3 ($T_L<\tau\leq T_M$).

When the print time is indicated by a numerical value within the first range R1 ($0<\tau\leq T_L$), the ejection limit is not reached even when the micro vibration of the strength $V_L$ is continued in the print time $\tau$. Therefore, when the print time $\tau$ is a numerical value included in the first range R1, the control unit 21 sets the micro vibration as the strength $V_L$ as illustrated in FIG. 7 (Sb2).

When the print time $\tau$ is a numerical value included in the second range R2 ($T_L<\tau\leq T_M$) and the micro vibration has the strength $V_L$, the ejection limit is reached when the limit time $T_L$ has elapsed. On the other hand, even when the micro vibration of the strength $V_M$ is continued in the print time, the ejection limit is not reached. Therefore, when the print time $\tau$ is a numerical value included in the second range R2, the control unit 21 sets the micro vibration of the strength $V_M$ (Sb3).

When the print time $\tau$ is a numerical value included in the third range R3 ($T_M<\tau\leq T_H$) and the micro vibration has the strength $V_M$, the ejection limit is reached when the limit time $T_M$ has elapsed. On the other hand, even when the micro vibration of the strength $V_H$ is continued in the print time $\tau$, the ejection limit is not reached. Therefore, when the print time $\tau$ is a numerical value included in the third range R3, the control unit 21 sets the micro vibration of the strength $V_H$ (Sb4).

As is apparent from the foregoing description, when the print time $\tau$ is a first period, the strength of the micro vibration is set to a first strength. On the other hand, when the print time $\tau$ is a second period which is longer than the first period, the strength of the micro vibration is set to a second strength which is higher than the first strength. Assuming that the numerical value in the first range R1 corresponds to the first period and the numerical value in the second range R2 corresponds to the second period, the strength $V_L$ corresponds to the first strength and the strength $V_M$ corresponds to the second strength. Assuming that the numerical value in the second range R2 corresponds to the first period and the numerical value in the third range R3 corresponds to the second period, the strength $V_M$ corresponds to the first strength and the strength $V_H$ corresponds to the second strength. Assuming that the numerical value in the first range R1 corresponds to the first period and the numerical value in the third range R3 corresponds to the second period, the strength $V_L$ corresponds to the first strength and the strength $V_H$ corresponds to the second strength.

When the strength of the micro vibration is set in the procedure described above, the control unit 21 causes the liquid ejecting head 23 to perform the cleaning operation (Sb5). When the cleaning operation is terminated, the control unit 21 causes the liquid ejecting head 23 to execute the print operation (Sb6). In the print operation, micro vibration having strength set in accordance with the print time $\tau$ is assigned to the nozzles N in the non-ejection state.

When the print operation is terminated, the control unit 21 causes the liquid ejecting head 23 to execute the flushing operation (Sb7). An ejection amount in the flushing operation is set in accordance with the strength of the micro vibration in the print operation. Specifically, when micro vibration has the strength $V_L$ in the print operation, the ejection amount $F_L$ of ink is ejected in the flushing operation. When the micro vibration has the strength $V_M$ in the print operation, the ejection amount $F_M$ of ink is ejected in the flushing operation. When the micro vibration has the strength $V_H$ in the print operation, the ejection amount $F_H$ of ink is ejected in the flushing operation.

As is apparent from the description above, when the strength of the micro vibration is the first strength in the print operation, the first ejection amount of ink is ejected in the flushing operation executed after the print operation. Furthermore, when the strength of the micro vibration in the print operation is the second strength which is larger than the first strength, the second ejection amount of ink which is larger than the first ejection amount is ejected. For example, assuming that the strength $V_L$ corresponds to the first strength and the strength $V_M$ corresponds to the second strength, the ejection amount $F_L$ corresponds to the first ejection amount and the ejection amount $F_M$ corresponds to the second ejection amount. Assuming that the strength $V_M$ corresponds to the first strength and the strength $V_H$ corresponds to the second strength, the ejection amount $F_M$ corresponds to the first ejection amount and the ejection amount $F_H$ corresponds to the second ejection amount. Assuming that the strength $V_L$ corresponds to the first strength and the strength $V_H$ corresponds to the second strength, the ejection amount $F_L$ corresponds to the first ejection amount and the ejection amount $F_H$ corresponds to the second ejection amount. Specifically, as the strength of the micro vibration in the print operation is higher, the ejection amount in the flushing operation performed after the print operation is larger.

When the print time $\tau$ is equal to or shorter than the limit time $T_H$ (Sa3: YES), the operation is performed as described above. On the other hand, when the print time $\tau$ is longer than the limit time $T_H$ (Sa3: NO), the control unit 21 sets a remaining period $\lambda$ in accordance with the print time $\tau$ as illustrated in FIG. 8 (Sc0). The remaining period $\lambda$ is obtained by subtracting a period of time corresponding to M limit times $T_H$ (M is a natural number) from the print time $\tau$ ($\lambda=\tau-M\cdot T_H$). The number M is set such that the remaining period $\lambda$ becomes a positive number smaller than the limit time $T_H$.

Figure 10:
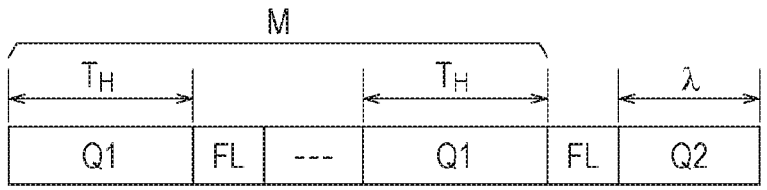
FIG. 10 is a diagram illustrating an operation of the liquid ejecting head performed when the print time exceeds a limit time.

FIG. 10 is a diagram illustrating an operation of the liquid ejecting head 23 when the print time $\tau$ exceeds the limit time $T_H$. As illustrated in FIG. 10, when the print time $\tau$ is larger than the limit period $T_H$, a period of time in which the print operation is performed includes M first periods Q1 and one second period Q2. Each of the M first periods Q1 corresponds to the limit time $T_H$ (an example of a predetermined length). The second period Q2 corresponds to the remaining period $\lambda$. Therefore, the second period Q2 is shorter than the limit time $T_H$. The second period Q2 is positioned after the M first periods Q1.

The print operation is executed in each of the M first periods Q1, and the flushing operation is executed every time the first period Q1 is terminated. In FIG. 10, the flushing operation is represented by a reference character $F_L$. Micro vibration in the print operation in the first period Q1 has the strength $V_H$. Furthermore, in the flushing operation immediately after the first period Q1, the ejection amount $F_H$ of ink corresponding to the micro vibration of the strength $V_H$ is ejected. As described above, the strength of the micro vibration corresponding to the first period Q1 and the ejection amount in the flushing operation are fixed values.

The print operation is also executed in the second period Q2. Print instructed by the single print job J is realized by the print operations in the M first periods Q1 and the print operation in the single second period Q2. Micro vibration in the print operation in the second period Q2 has the strength corresponding to the remaining period $\lambda$ in the second period Q2. As is apparent from the foregoing description, when the print time $\tau$ is longer than the limit time $T_H$, the print operation in which the micro vibration of the strength $V_H$ is set and the flushing operation of the ejection amount $F_H$ are repeatedly performed M times before the print operation in which the strength of the micro vibration is set in accordance with the remaining period $\lambda$ is executed.

When the remaining period $\lambda$ is set (Sc0), the control unit 21 determines a range of the remaining period $\lambda$ as illustrated in FIG. 8 (Sc1). Specifically, the control unit 21 determines one of the first to third ranges R1 to R3 which includes the remaining period $\lambda$. Definitions of the first to third ranges R1 to R3 are the same as those of the ranges R of the determination of the print time $\tau$ (Sb1).

When the remaining period $\lambda$ is a numerical value included in the first range R1 ($0<\lambda\leq T_L$), the ejection limit is not reached even when the micro vibration of the strength $V_L$ is continued in the remaining period $\lambda$. Therefore, when the remaining period $\lambda$ is a numerical value included in the first range R1, the control unit 21 sets the micro vibration of the strength $V_L$ in the second period Q2 (Sc2).

When the remaining period $\lambda$ is a numerical value included in the second range R2 ($T_L<\lambda\leq T_M$) and the micro vibration has the strength $V_L$, the ejection limit is reached when the limit time $T_L$ has elapsed. On the other hand, even when the micro vibration of the strength $V_M$ is continued in the remaining period $\lambda$, the ejection limit is not reached. Therefore, when the remaining period $\lambda$ is a numerical value included in the second range R2, the control unit 21 sets the micro vibration of the strength $V_M$ in the second period Q2 (Sc3).

When the remaining period $\lambda$ is a numerical value included in the third range R3 ($T_M<\lambda<T_H$) and the micro vibration has the strength $V_M$, the ejection limit is reached when the limit time $T_M$ has elapsed. On the other hand, even when the micro vibration of the strength $V_H$ is continued in the remaining period $\lambda$, the ejection limit is not reached. Therefore, when the remaining period $\lambda$ is a numerical value included in the third range R3, the control unit 21 sets the micro vibration of the strength $V_H$ in the second period Q2 (Sc4).

As is apparent from the description above, when the remaining period $\lambda$ in the second period Q2 is the third period, strength of the micro vibration in the second period Q2 is set to third strength. Furthermore, when the remaining period $\lambda$ in the second period Q2 is a fourth period which is longer than the third period, strength of the micro vibration in the second period Q2 is set to a fourth strength which is higher than the third strength. Assuming that the numerical value in the first range R1 corresponds to the third period and the numerical value in the second range R2 corresponds to the fourth period, the strength $V_L$ corresponds to the third strength and the strength $V_M$ corresponds to the fourth strength. Assuming that the numerical value in the second range R2 corresponds to the third period and the numerical value in the third range R3 corresponds to the fourth period, the strength $V_M$ corresponds to the third strength and the strength $V_H$ corresponds to the fourth strength. Assuming that the numerical value in the first range R1 corresponds to the third period and the numerical value in the third range R3 corresponds to the fourth period, the strength $V_L$ corresponds to the third strength and the strength $V_H$ corresponds to the fourth strength.

After the strength of the micro vibration in the second period Q2 is set by the procedure described above, the control unit 21 causes the liquid ejecting head 23 to execute the cleaning operation (Sc5). After the cleaning operation is terminated, the control unit 21 causes the liquid ejecting head 23 to execute the print operation (Sc6). Specifically, the control unit 21 executes the print operation and the flushing operation every first period Q1 and executes the print operation in the second period Q2. As described above, the micro vibration of the strength $V_H$ is applied to the nozzles N in the non-ejection state in the print operation in the first period Q1, and the ejection amount $F_H$ of ink is ejected in the flushing operation performed after the print operation. Furthermore, in the print operation in the second period Q2, micro vibration of strength set in accordance with the remaining period λ is applied to the nozzles N in the non-ejection state.

When the process described above is terminated, the control unit 21 causes the liquid ejecting head 23 to execute the flushing operation (Sc7). The ejection amount in the flushing operation is set in accordance with the strength of the micro vibration in the print operation in the second period Q2. Specifically, when the micro vibration has the strength $V_L$ in the second period Q2, the ejection amount $F_L$ of ink is ejected by the flushing operation. When the micro vibration has the strength $V_M$ in the second period Q2, the ejection amount $F_M$ of ink is ejected by the flushing operation. When the micro vibration has the strength $V_H$ in the second period Q2, the ejection amount $F_H$ of ink is ejected by the flushing operation.

As is apparent from the description above, when the micro vibration has the third strength in the second period Q2, the third ejection amount of ink is ejected in the flushing operation executed after the second period Q2 has elapsed. Furthermore, when the micro vibration has the fourth strength in the second period Q2, the fourth ejection amount of ink is ejected in the flushing operation executed after the second period Q2 has elapsed. For example, assuming that the strength $V_L$ corresponds to the third strength and the strength $V_M$ corresponds to the fourth strength, the ejection amount $F_L$ corresponds to the third ejection amount and the ejection amount $F_M$ corresponds to the fourth ejection amount. Assuming that the strength $V_M$ corresponds to the third strength and the strength $V_H$ corresponds to the fourth strength, the ejection amount $F_M$ corresponds to the third ejection amount and the ejection amount $F_H$ corresponds to the fourth ejection amount. Assuming that the strength $V_L$ corresponds to the third strength and the strength $V_H$ corresponds to the fourth strength, the ejection amount $F_L$ corresponds to the third ejection amount and the ejection amount $F_H$ corresponds to the fourth ejection amount. Specifically, as the strength of the micro vibration in the print operation in the second period Q2 is higher, the ejection amount in the flushing operation performed after the print operation is larger.

Note that, in a configuration in which micro vibration has the strength $V_H$ irrespective of the print time τ (hereinafter referred to as a "comparative example"), for example, the ejection amount $F_H$ of ink is ejected in the flushing operation performed after the print operation. However, when the print time τ is short, for example, micro vibration of the strength $V_L$ is sufficient for reducing increase in viscosity in practice. Accordingly, in the flushing operation performed after the print operation, the sufficient ejection amount $F_L$ of ink is ejected. Specifically, in the comparative example, unrequired ink may be consumed by the flushing operation performed after the print operation. In contrast to the comparative example described above, the strength of the micro vibration in the print operation is set in accordance with the print time τ according to the first embodiment. Furthermore, an ejection amount in the flushing operation performed after the print operation is set in accordance with the strength of the micro vibration in the print operation. Accordingly, it is advantageous in that consumption of ink in the flushing operation may be suppressed.

B: Second Embodiment

A second embodiment will be described. In modes illustrated hereinafter, components having functions the same as those of the first embodiment are denoted by reference numerals the same as those of the first embodiment and detailed descriptions thereof are omitted where appropriate.

A control unit 21 of the second embodiment selects one of a plurality of operation modes including operation modes A to C. Specifically, the control unit 21 selects one of the plurality of operation modes in accordance with an instruction issued by a user using an external apparatus 200 or an operation device 26. The control unit 21 causes a liquid ejecting head 23 to execute an operation corresponding to the selected operation mode.

In the operation mode A, a maximum value of strength of micro vibration is a strength $V_H$. When the operation mode A is selected, the control unit 21 controls the liquid ejecting head 23 similarly to the first embodiment. Specifically, when a print time τ is equal to or shorter than a limit time $T_H$, the liquid ejecting head 23 executes a print operation in which strength of micro vibration is set in accordance with the print time τ and a flushing operation of an ejection amount F set in accordance with the strength of the micro vibration. On the other hand, when the print time τ is longer than the limit time $T_H$, the liquid ejecting head 23 executes a print operation with micro vibration of the strength $V_H$ and the flushing operation with the ejection amount $F_H$ in a first period Q1, and executes a print operation with strength of micro vibration set in accordance with a remaining period λ and a flushing operation with an ejection amount F obtained in accordance with the strength of the micro vibration in a second period Q2.

In the operation mode B, a maximum value of the strength of the micro vibration is the strength $V_M$ which is smaller than the strength $V_H$. When the operation mode B is selected, the control unit 21 determines whether the print time τ is equal to or shorter than the limit time T (Sa3). When the print time is equal to or shorter than the limit time $T_M$ (Sa3: YES), the control unit 21 sets one of the strength $V_L$ and the strength $V_M$ in accordance with the print time τ. Specifically, the control unit 21 sets the micro vibration of the strength $V_L$ when the print time τ is a numerical value included in a first range R1 ($0<\tau\leq T_L$), and when the print time τ is a numerical value included in a second range R2 ($T_L<\tau\leq T_M$), the micro vibration of the strength $V_M$ is set. The liquid ejecting head 23 executes a print operation in which strength of micro vibration is set in accordance with the print time τ and a flushing operation of an ejection amount F in accordance with the strength.

When the print time τ is longer than the limit time $T_M$ (Sa3), the control unit 21 calculates a remaining period λ by subtracting a period of time corresponding to M limit times $T_M$ from the print time τ ($\lambda=\tau-M\cdot T_M$). A period of time in which the print operation is executed includes M first periods Q1 and one second period Q2. The first period Q1 corresponds to the limit time $T_M$, and the second period Q2 corresponds to the remaining period λ. In the first period Q1, a print operation in which the micro vibration has the strength $V_M$ and the flushing operation of the ejection amount $F_M$ are executed. On the other hand, in the second period Q2, a print operation in which the micro vibration has the strength $V_M$ or the strength $V_L$ in accordance with the remaining period λ is executed. After the second period Q2 has elapsed, the flushing operation of the ejection amount F ($F_M$ or $F_L$) corresponding to the strength of the micro vibration in the second period Q2 is executed.

In the operation mode C, the micro vibration only has the strength $V_L$. When the operation mode C is selected, the liquid ejecting head 23 repeatedly performs the print operation with the micro vibration of the strength $V_L$ and the flushing operation with the ejection amount $F_L$ every limit time $T_L$.

In the operation mode A, a maximum value of the strength of the micro vibration is the strength $V_H$. Therefore, as is apparent from FIG. 4, when compared with the operation modes B and C, the ejection amount in the single flushing operation is larger and frequency of the flushing operation is lower in the operation mode A. Accordingly, a print speed in the operation mode A is higher than those in the operation modes B and C. On the other hand, the micro vibration only has the strength $V_L$ in the operation mode C. Therefore, as is apparent from FIG. 4, when compared with the operation modes A and B, frequency of the flushing operation is higher and an ejection amount in the single flushing operation is smaller. Accordingly, an amount of consumption of ink in the operation mode C is smaller than those in the operation modes A and B. As is apparent from the foregoing description, the operation mode A is preferable when a print speed has priority whereas the operation mode C is preferable when reduction in an ink consumption amount has priority. Furthermore, the operation mode B is preferable when both the print speed and the reduction in an ink consumption amount have priority.

Note that, when the operation mode A is an example of the "first mode", the operation mode B or the operation mode C corresponds to an example of the "second mode". When the operation mode B is an example of the "first mode", the operation mode C corresponds to an example of the "second mode".

C: Third Embodiment

A plurality of print jobs J are successively supplied from an external apparatus 200 or an operation device 26 to a control unit 21. In the third embodiment, a first print job J1 and a second print job J2 which are successively supplied from the external apparatus 200 or the operation device 26 are focused. The print job J2 is one of the print jobs J which is input immediately after the first print job J1. The second print job J2 is supplied from the external apparatus 200 or the operation device 26 to the control unit 21 before termination of a print operation performed on the first print job J1.

As described with reference to FIG. 4, a limit time T in which nozzles N reach an ejection limit varies depending on strength of micro vibration. Then a maintenance operation is not executed until the limit time T has elapsed, and the print operation using the micro vibration of strength corresponding to the limit period T may be continued.

Figure 11:
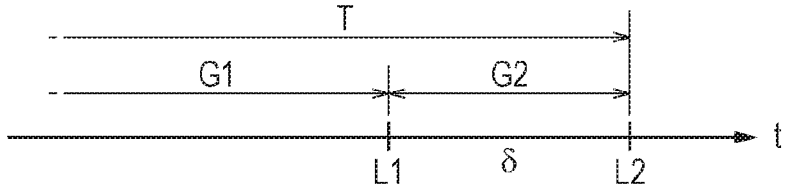
FIG. 11 is a diagram illustrating an operation of a liquid ejecting head according to a third embodiment.

On the other hand, as illustrated in FIG. 11, a first print operation corresponding to a first print job J1 may be terminated before a time point L2 when the limit time T is terminated. In a first period G1 of FIG. 11, the first print operation is executed. As is apparent from FIG. 11, a second period G2 corresponding to a period δ is started at a termination point L1 of the first period G1 for the first print job J1 and terminated at the time point L2 when the limit time T is terminated. The control unit 21 of the third embodiment causes a liquid ejecting head 23 to execute a second print operation for the second print job J2 in the second period G2 after the first print operation is terminated. The flushing operation is not executed between the first and second print operations.

The control unit 21 sets strength of micro vibration in the second print operation in the second period G2 to strength equivalent to that of micro vibration in the first print operation in the first period G1. Specifically, the strength of the micro vibration in the first print operation is taken over by the second print operation. When the second period G2 is terminated, the control unit 21 causes the liquid ejecting head 23 to execute a flushing operation with an ejection amount corresponding to the strength of the micro vibration in the second period G2. When the micro vibration in the second period G2 has the strength $V_L$, a flushing operation with an ejection amount $F_L$ is performed, when the micro vibration in the second period G2 has the strength $V_M$, a flushing operation with an ejection amount $F_M$ is performed, and when the micro vibration in the second period G2 has the strength $V_H$, a flushing operation with an ejection amount $F_H$ is performed.

After the second period G2 is terminated, the control unit 21 causes the liquid ejecting head 23 to perform a remaining print operation for the second print job J2. An operation performed after the second period G2 is terminated is the same as that performed in the first embodiment. Note that a print time τ employed in a control process of the second print job J2 is obtained by subtracting the period δ corresponding to the second period G2 immediately before an initial print time τ0 from the print time τ0 specified in accordance with the second print job J2. Specifically, strength of micro vibration after the second period G2 is terminated is set in accordance with the print time τ obtained by subtracting the period δ from the initial print time τ0.

The same effect as the first embodiment is realized in the third embodiment. In the third embodiment, in particular, when the first print operation is terminated before the limit time T corresponding to the strength of the micro vibration for the first print job J1 is terminated, the second print operation having strength of micro vibration set to be the same as that of the first print operation is executed in the second period G2. Accordingly, a print speed may be improved when compared with the configuration in which the second print operation is started after the limit time T is terminated. Furthermore, in the third embodiment, strength of micro vibration obtained after the second period is terminated is set in accordance with the print time τ obtained by subtracting the period δ of the second period G2 from the print time τ0 for the second print job J2. Therefore, the strength of the micro vibration in the print operation of the second print job J2 may be appropriately set taking the second print operation executed in the second period G2 into consideration.

D: Modification

The foregoing embodiments may be variously modified. A modification to be employed in the foregoing embodiments described above will be described in detail. Two or more modes arbitrarily selected from examples below may be appropriately combined as long as the modes are consistent with each other.

(1) Although an operation mode is selected in accordance with an instruction issued by a user using the external apparatus 200 or the operation device 26, in the second embodiment, a method for selecting an operation mode is not limited to that illustrated above. For example, the following modes are assumed taking a condition in which a print speed in the operation mode A is higher than those in the operation modes B and C and a consumption amount of ink in the operation mode C is smaller than those in the operation modes A and B into consideration.

1: First Mode

A control unit 21 selects an operation mode in accordance with an amount of remaining ink in a liquid container 12.

Specifically, the control unit 21 selects an operation mode A when an amount of remaining ink is a numerical value included in a first range (an example of a first amount). The control unit 21 selects an operation mode B when an amount of remaining ink is a numerical value included in a second range (an example of a second amount) lower than the first range. The control unit 21 selects an operation mode C when an amount of remaining ink is a numerical value included in a third range lower than the second range. Specifically, when a sufficient amount of ink is stored in the liquid container 12, an operation mode in which a print speed has priority (the operation mode A or the operation mode B) is selected. On the other hand, when an amount of remaining ink in the liquid container 12 is small, an operation mode in which reduction of a consumption amount of ink has priority (the operation mode B or the operation mode C) is selected.

2: Second Mode

A control unit 21 selects an operation mode in accordance with the number of sheets to be printed instructed by a print job J. Specifically, the control unit 21 selects an operation mode A when the number of sheets to be printed is a numerical value included in a first range (an example of a first value). The control unit 21 selects the operation mode B when the number of sheets to be printed is a numerical value included in a second range (an example of a second value) lower than the first range. The control unit 21 selects an operation mode C when the number of sheets to be printed is a numerical value included in a third range lower than the second range. Specifically, when the number of sheets to be printed is large, an operation mode in which a print speed has priority (the operation mode A or the operation mode B) is selected. On the other hand, when the number of sheets to be printed is small, an operation mode in which reduction of a consumption amount of ink has priority (the operation mode B or the operation mode C) is selected.

(2) Although strength of micro vibration is set before start of the print operation in the foregoing embodiments, strength of micro vibration may be set where appropriate as the print operation proceeds. For example, before start of each of first periods Q1, strength of micro vibration in the first period Q1 and an ejection amount in a flushing operation may be set.

(3) Although a configuration in which a second period Q2 is positioned after the M first periods Q1 is illustrated in the foregoing embodiments, the temporal relationship between the first periods Q1 and the second period Q2 is not limited to the example described above. For example, a configuration in which the second period Q2 is positioned before the M first periods Q1 or a configuration in which the second period Q2 is positioned between the two consecutive first periods Q1 may be employed.

(4) Although the configuration in which micro vibration has three stages of strength is illustrated in the foregoing embodiments, the number of stages of the strength of the micro vibration may be arbitrarily set. For example, the micro vibration may have two stages of strength of micro vibration or four or more stages of strength of micro vibration.

(5) Although the limit time T which varies depending on strength of micro vibration is illustrated in the foregoing embodiments, the limit time T may depend on elements other than the strength of the micro vibration. For example, the limit time T may be set in accordance with temperature or humidity of environment where a liquid ejecting apparatus 100 is used. For example, a long limit time T is set since viscosity of ink is lowered as temperature is increased. A short limit time T is set since viscosity is increased as humidity is lower.

(6) Although the driving elements E are used for the ejection of the ink and the micro vibration in common in the foregoing embodiments, different driving elements E may be used for the ejection of the ink and the micro vibration. The driving elements E for the ejection and the driving elements E for the micro vibration may have the same configuration or different configurations. For example, heat elements may be used as the driving elements E for the ejection and piezoelectric elements may be used as the driving elements E for the micro vibration.

(7) When failure, such as a paper jam, accidentally occurs although the operations illustrated in the foregoing embodiments are performed, a maintenance operation, such as the flushing operation or the cleaning operation, is forcibly executed.

(8) Although the strength of the micro vibration is controlled by controlling the voltage A of the micro vibration pulse Pb in the foregoing embodiments, the method for controlling the strength of the micro vibration is not limited to the example described above. For example, the strength of the micro vibration may be controlled by controlling a frequency of the micro vibration pulse Pb. Specifically, the strength of the micro vibration may be controlled in accordance with frequency of supply of the micro vibration pulse Pb to the driving elements E within a predetermined period of time. Specifically, the strength of the micro vibration may be increased by increasing the frequency of the micro vibration pulse Pb. Furthermore, the strength of the micro vibration may be controlled by controlling a temporal change (an inclination) of a voltage in the micro vibration pulse Pb. Specifically, the strength of the micro vibration may be increased by increasing an inclination of a potential of the micro vibration pulse Pb in the interval s4 or the interval s6. As is apparent from the foregoing description, the strength of the micro vibration is set in accordance with at least one of a voltage of the micro vibration pulse Pb, frequency of the micro vibration pulse Pb, and an inclination of the micro vibration pulse Pb in a preferred embodiment.

(9) Although the line head having the plurality of nozzles N arranged in an entire width of the medium 11 is illustrated in the foregoing embodiments, the present disclosure is applied to a serial-type liquid ejecting apparatus 100 having a liquid ejecting head 23 reciprocating along an X axis.

(10) The liquid ejecting apparatus 100 illustrated in the foregoing embodiments may be employed in various apparatuses including facsimile apparatuses and photocopiers in addition to apparatuses dedicated for printing. However, usage of a liquid ejection apparatus is not limited to printing. For example, a liquid ejection apparatus ejecting color solvent may be used as a manufacturing apparatus which forms a color filter of a display apparatus, such as a liquid crystal display panel. Furthermore, the liquid ejection apparatus ejecting solvent of dielectric material is used as a manufacturing apparatus which forms wiring and electrodes of wiring substrates. Moreover, the liquid ejection apparatus ejecting organic solvent of living bodies is used as a manufacturing apparatus which manufactures biochips, for example.

E: Appendix

Configurations described below, for example, are recognized according to the embodiments illustrated above.

Preferred Aspect

According to a first aspect, a liquid ejecting apparatus executes a print operation of ejecting liquid to a medium when a print job is input and includes nozzles configured to eject liquid, piezoelectric elements corresponding to the nozzles, and driving circuits configured to supply a micro vibration pulse for generating micro vibration in the liquid included in the nozzles without ejection of the liquid from the nozzles to the piezoelectric elements. Strength of the micro vibration generated by the micro vibration pulse varies depending on the print job. According to the aspect, since the strength of the micro vibration depends on the print job, possibility that liquid having increased viscosity in the nozzles excessively intrudes to a depth side from the nozzles is reduced. Accordingly, an ejection amount in the flushing operation may be reduced.

The term "print job" indicates an instruction of a series of operations performed to obtain a printed medium. The print job instructs various conditions including the number of copies, duty, color/monochrome, a medium size, an image quality mode (high quality/normal/low quality), and a direction of the medium to be transported by a transport mechanism 22 (a longitudinal direction/a lateral direction). The phrase "strength of the micro vibration varies depending on the print job" means that strength of the micro vibration depends on at least a portion of a condition instructed by the print job.

Concrete Example of First Aspect

According to a second aspect, the strength of the micro vibration varies depending on a period of time required for the print operation specified by the print job. Accordingly, since the strength of the micro vibration depends on the period of time required for the print operation, an ejection amount in a flushing operation may be efficiently reduced.

Concrete Example of Second Aspect

According to a third aspect, when the period of time required for the print operation is a first period, the micro vibration has a first strength, and when the period of time required for the print operation is a second period longer than the first period, the micro vibration has a second strength higher than the first strength. Accordingly, since the strength of the micro vibration depends on the period of time required for the print operation, an ejection amount in the flushing operation may be efficiently reduced.

Concrete Example of Third Aspect

According to a fourth aspect, when the micro vibration has the first strength, a first ejection amount of liquid is ejected in a flushing operation to be executed after the print operation is performed, and when the micro vibration has the second strength, a second ejection amount of liquid larger than the first ejection amount is ejected in the flushing operation to be executed after the print operation. Accordingly, since the ejection amount in the flushing operation depends on the strength of the micro vibration, an ejection amount in the flushing operation may be efficiently reduced.

Concrete Example of First Aspect

According to a fifth aspect, a period of time in which the print operation is executed includes one or more first periods having a predetermined length and a second period which is not included in the one or more first periods and which is shorter than the predetermined length, the flushing operation is performed every first period, the micro vibration in each of the one or more first periods has a predetermined strength, and the second period has a strength of the micro vibration depending on a period of time of the second period. Accordingly, even when the print operation is performed for a long period of time, the ejection amount in the flushing operation may be reduced.

Concrete Example of Fifth Aspect

According to a sixth aspect, when the period of time of the second period is a third period, the micro vibration has a third strength in the second period, and when the period of time of the second period is a fourth period longer than the third period, the micro vibration has a fourth strength higher than the third strength in the second period. According to this aspect, the strength of the micro vibration in the second period depends on the period of time of the second period. Accordingly, even when the print operation is performed for a long period of time, the ejection amount in the flushing operation may be reduced.

Concrete Example of Sixth Aspect

According to a seventh aspect, when the micro vibration has the third strength in the second period, a third ejection amount of liquid is ejected in the flushing operation performed after the second period is terminated, and when the micro vibration has the fourth strength in the second period, a fourth ejection amount of liquid larger than the third ejection amount of liquid is ejected in the flushing operation performed after the second period is terminated. Accordingly, since the ejection amount in the flushing operation depends on the strength of the micro vibration, the ejection amount in the flushing operation may be reduced.

Concrete Example of First Aspect

According to an eighth aspect, in a case where a second print job is input after a first print job is input, when a first print operation in which strength of micro vibration is set in accordance with the first print job is terminated in a first period before a predetermined period of time corresponding to the strength is terminated, a second print operation corresponding to the second print job is executed in a second period from when the first print operation is terminated to when the predetermined period of time is terminated, and strength of micro vibration in the second print operation is set to be equal to the strength of the micro vibration in the first print operation. According to this aspect, when the first print operation is terminated before the predetermined period of time corresponding to the strength of the micro vibration for the first print job is terminated, the second print operation is executed in which the strength of the micro vibration is set equal to the strength of the first print operation in the remaining second period. Accordingly, a print speed may be improved when compared with a configuration in which the second print operation is started after the predetermined period of time.

Concrete Example of Eighth Aspect

According to an ninth aspect, strength of micro vibration obtained after the second period is set in accordance with a period of time obtained by subtracting the period of time of the second period from the period of time required for the print operation specified by the second print job. Accordingly, the strength of the micro vibration in the print operation for the second print job may be appropriately set taking the second print operation executed in the second period into consideration.

Preferred Aspect

According to a tenth aspect, a liquid ejecting apparatus includes nozzles configured to eject liquid, piezoelectric elements corresponding to the nozzles, and driving circuits configured to supply a micro vibration pulse for generating micro vibration in the liquid included in the nozzles without ejection of the liquid from the nozzles to the piezoelectric elements. The liquid ejecting apparatus operates in one of a plurality of modes including a first mode in which a maximum value of strength of micro vibration generated by the micro vibration pulse is a first strength and a second mode in which a maximum value of strength of micro vibration generated by the micro vibration pulse is a second strength lower than the first strength. Since the maximum value of the strength of the micro vibration is the first strength in the first mode, frequency of the flushing operation is lowered. Accordingly, in the first mode, the print operation may be executed at higher print speed (throughput) when compared with the second mode. On the other hand, since the micro vibration of the strength having the maximum value of the second strength lower than the first strength is applied to the liquid in the second mode, an ejection amount in the flushing operation may be reduced when compared with the first mode.

Concrete Example of Tenth Aspect

According to an eleventh aspect, one of the first and second modes is selected in accordance with an instruction issued by a user. Accordingly, it is advantageous in that the user may selectively give priority on improvement in a print speed or reduction in an ejection amount in the flushing operation.

Concrete Example of Tenth Aspect

According to a twelfth aspect, the liquid ejecting apparatus ejects liquid stored in a liquid container. When an amount of remaining liquid in the liquid container is a first amount, the first mode is selected, and when an amount of remaining liquid in the liquid container is a second amount smaller than the first amount, the second mode is selected. Accordingly, the print speed has priority in a state in which a sufficient amount of liquid is stored in the liquid container, and the reduction in an ejection amount in the flushing operation has priority in a state in which an amount of remaining liquid is small.

Concrete Example of Tenth Aspect

According to a thirteenth aspect, the liquid ejecting apparatus executes a print operation of ejecting liquid to a medium in accordance with a print job. The print job indicates the number of sheets to be printed in the print operation. The first mode is selected when the number of sheets to be printed is a first value. The second mode is selected when the number of sheets to be printed is a second value smaller than the first value. Accordingly, the print speed has priority when the number of sheets to be printed is large, and the reduction in an ejection amount in the flushing operation has priority when the number of sheets to be printed is small.

Concrete Example of any One of First to Thirteenth Aspect

According to a fourteenth aspect, strength of the micro vibration is set in accordance with at least one of a voltage of the micro vibration pulse, a frequency of the micro vibration pulse, and an inclination of the micro vibration pulse.

Preferred Aspect

According to a fifteenth aspect, a method controls a liquid ejecting apparatus which executes a print operation of ejecting liquid to a medium when a print job is input and which includes nozzles ejecting liquid, piezoelectric elements corresponding to the nozzles, and driving circuits supplying a micro vibration pulse for generating micro vibration in the liquid in the nozzles without ejection of the liquid from the nozzles to the piezoelectric elements. Strength of the micro vibration generated by the micro vibration pulse is controlled in accordance with the print job.

Concrete Example of Fifteenth Aspect

According to a sixteenth aspect, the strength of the micro vibration is controlled in accordance with a period of time required for the print operation specified by the print job.

Preferred Aspect

According to a seventeenth aspect, a method controls a liquid ejecting apparatus including nozzles ejecting liquid, piezoelectric elements corresponding to the nozzles, and driving circuits supplying a micro vibration pulse for generating micro vibration in the liquid in the nozzles to the piezoelectric elements without ejection of the liquid from the nozzles. The liquid ejecting apparatus operates in one of a plurality of modes including a first mode in which a maximum value of strength of the micro vibration generated by the micro vibration pulse is a first strength and a second mode in which a maximum value of strength of the micro vibration generated by the micro vibration pulse is a second strength lower than the first strength.

What is claimed is:

1. A liquid ejecting apparatus executing a print operation of ejecting liquid to a medium when a print job is input, comprising:

nozzles configured to eject liquid;

piezoelectric elements corresponding to the nozzles driving circuits configured to supply a plurality of micro vibration pulses for generating micro vibrations in the liquid included in the nozzles without ejection of the liquid from the nozzles to the piezoelectric elements during a period of time for the print operation ($\tau$); and a print controller that controls the strength of the micro vibrations generated by the micro vibration pulses based on the print job, wherein the strength of the micro vibrations include a first strength ($V_H$) and a second strength ($V_L$ or $V_M$) lower than the first strength, the first strength being the strongest among the strengths of the micro vibrations, the print controller determines the period of time for the print operation specified by the print job, when the period of time for the print operation is equal to or shorter than a first period ($T_H$ or Q1) corresponding to the first strength and having a predetermined length, the print controller sets the strength of the micro vibrations based on the period of time for the print operation and applies it to the nozzles in the period of time for the print operation, when the period of time for the print operation is longer than the first period, the print controller separates the period of time for the print operation into one or more of the first periods and a remaining period ($\lambda$ or $Q_2$) that is shorter than the first period and sets the strength of the micro vibrations based on the remaining period and applies it to the nozzles in the remaining period.

2. The liquid ejecting apparatus according to claim 1, wherein when the period of time for the print operation is equal to or shorter than the first period and longer than a second period ($T_L$ or $T_M$), the print controller sets the strength of the micro vibration as the first strength in the period of time for the print operation, the second period corresponding to the second strength and having a predetermined length shorter than the first period, and when the period of time for the print operation is equal to or shorter than the second period, the print controller sets the strength of the micro vibration as the second strength in the period of time for the print operation.

3. The liquid ejecting apparatus according to claim 2, wherein when the strength of the micro vibration in the period of time for the print operation is the first strength, a first ejection amount of liquid ($F_H$) is ejected in a flushing operation to be executed after the period of time for the print operation, and when the strength of the micro vibration in the period for the print operation is the second strength, a second ejection amount of liquid ($F_L$ or $F_M$) smaller than the first ejection amount is ejected in the flushing operation to be executed after the period of time for the print operation.

4. The liquid ejecting apparatus according to claim 1, wherein when the period of time for the print operation is longer than the first period:

when the remaining period is longer than a second period, the print controller sets the strength of the micro vibration as the first strength in each of one or more the first periods and the remaining period, the second period corresponding to the second strength and having a predetermined length shorter than the first period, and when the remaining period is equal to or shorter than the second period, the print controller sets strength of the micro vibration as the first strength in each of one or more the first periods and sets the strength of the micro vibration as the second strength in the remaining period.

5. The liquid ejecting apparatus according to claim 4, wherein a flushing operation is performed every one or more first periods and the second period, when the strength of the micro vibration in the remaining period is the first strength, a first ejection amount of liquid ($F_H$) is ejected in the flushing operation to be executed after the remaining period, and when the strength of the micro vibration in the remaining period is the second strength, a second ejection amount of liquid ($F_L$ or $F_M$) smaller than the first ejection amount is ejected in the flushing operation to be executed after the remaining period.

6. The liquid ejecting apparatus according to claim 5, wherein when the strength of the micro vibration in the remaining period is the first strength, the first ejection amount of liquid ($F_H$) is ejected in the flushing operation to be executed after each of one or more the first periods.

7. The liquid ejecting apparatus according to claim 1, wherein strength of the micro vibration is set in accordance with at least one of a voltage of the micro vibration pulse, a frequency of the micro vibration pulse, and an inclination of the micro vibration pulse.

8. A method for controlling a liquid ejecting apparatus which executes a print operation of ejecting liquid to a medium when a print job is input and which includes nozzles ejecting liquid, piezoelectric elements corresponding to the nozzles, driving circuits supplying a plurality of a micro vibration pulses for generating micro vibrations in the liquid in the nozzles without ejection of the liquid from the nozzles to the piezoelectric elements during a period of time for the print operation ($\tau$); and a print controller that controls the strength of the micro vibrations generated by the micro vibration pulses based on the print job, wherein the strength of the micro vibrations include a first strength ($V_H$) and a second strength ($V_L$ or $V_M$) lower than the first strength, the first strength being the strongest among the strengths of the micro vibrations, the print controller determines the period of time for the print operation specified by the print job, when the period of time for the print operation is equal to or shorter than a first period ($T_H$ or $Q_1$) corresponding to the first strength and having a predetermined length, the print controller sets the strength of the micro vibrations based on the period of time for the print operation and applies it to the nozzles in the period of time for the print operation, when the period of time for the print operation is longer than the first period, the print controller separates the period of time for the print operation into one or more the first periods and a remaining period ($\lambda$ or $Q_2$) that is shorter than the first period and sets the strength of the micro vibrations based on the remaining period and applies it to the nozzles in the remaining period.

* * * * *